US010590555B2

(12) United States Patent
Honkawa et al.

(10) Patent No.: US 10,590,555 B2
(45) Date of Patent: Mar. 17, 2020

(54) METHOD FOR PRODUCING ELECTROLYTIC ALUMINUM FOIL

(71) Applicant: UACJ Corporation, Tokyo (JP)

(72) Inventors: Yukio Honkawa, Tokyo (JP); Junji Nunomura, Tokyo (JP); Yoichi Kojima, Tokyo (JP)

(73) Assignee: UACJ Corporation, Tokyo (JP)

( * ) Notice: Subject to any disclaimer, the term of this patent is extended or adjusted under 35 U.S.C. 154(b) by 115 days.

(21) Appl. No.: 15/825,794

(22) Filed: Nov. 29, 2017

(65) Prior Publication Data

US 2018/0080134 A1 Mar. 22, 2018

Related U.S. Application Data

(63) Continuation of application No. PCT/JP2016/075874, filed on Sep. 2, 2016.

(30) Foreign Application Priority Data

Sep. 5, 2015 (JP) ..... 2015-175244
Aug. 15, 2016 (JP) ..... 2016-159099

(51) Int. Cl.
*C25D 1/04* (2006.01)
*C25D 1/20* (2006.01)
*C25D 3/66* (2006.01)

(52) U.S. Cl.
CPC ..... *C25D 1/04* (2013.01); *C25D 1/20* (2013.01); *C25D 3/665* (2013.01)

(58) Field of Classification Search
CPC ..... C25D 1/04; C25D 1/20
See application file for complete search history.

(56) References Cited

U.S. PATENT DOCUMENTS 5,712,046 A 1/1998 Kamidaira et al.
2004/0157080 A1 8/2004 Shinozaki
(Continued)

FOREIGN PATENT DOCUMENTS

CN 1551710 A 12/2004
CN 103282553 A 9/2013
(Continued)

OTHER PUBLICATIONS

Corresponding EP Application No. 16842021.4 Extended European Search Report dated Jan. 21, 2019.
(Continued)

*Primary Examiner* — Louis J Rufo
(74) *Attorney, Agent, or Firm* — Dorsey & Whitney LLP

(57) ABSTRACT

A method for producing high quality electrolytic aluminum foil excellent in peelability from a cathode surface is provided. A method for producing electrolytic aluminum foil according to the present disclosure is a method for producing electrolytic aluminum foil, comprising steps of depositing an aluminum film on a surface of a cathode in an electrolytic cell supplied with an electrolytic solution and comprising the cathode; and peeling the deposited aluminum film from the surface of the cathode to provide aluminum foil, wherein the cathode has surface roughness of an arithmetic average roughness (Ra) of 0.10 to 0.40 μm and a ten-point average roughness (Rz) of 0.20 to 0.70 μm.

6 Claims, 5 Drawing Sheets

(56) References Cited

U.S. PATENT DOCUMENTS

| | | | | |
|---|---|---|---|---|
| 2012/0292191 | A1* | 11/2012 | Goto | C25D 1/003 205/50 |
| 2014/0346050 | A1 | 11/2014 | Sakaida et al. | |
| 2014/0360882 | A1 | 12/2014 | Kim et al. | |
| 2016/0233514 | A1 | 8/2016 | Okamoto et al. | |

FOREIGN PATENT DOCUMENTS

| | | | | |
|---|---|---|---|---|
| CN | 104053824 | A | 9/2014 | |
| CN | 105531403 | A | 4/2016 | |
| JP | H0920990 | A | 1/1997 | |
| JP | 201480632 | A | 5/2014 | |
| JP | 5607862 | B1 * | 10/2014 | C25D 1/04 |
| JP | 2015124423 | A * | 7/2015 | |
| JP | 2015124423 | A | 7/2015 | |
| JP | WO2014119355 | A1 * | 1/2017 | C25D 1/04 |
| KR | 20130053115 | A | 5/2013 | |
| KR | 20150056497 | A | 5/2015 | |
| WO | 2013002273 | A1 | 1/2013 | |
| WO | 2013129588 | A1 | 9/2013 | |
| WO | 2014045986 | A1 | 3/2014 | |
| WO | 2014057747 | A1 | 4/2014 | |
| WO | 2015125900 | A1 | 8/2015 | |
| WO | WO-2018011326 | A1 * | 1/2018 | |

OTHER PUBLICATIONS

English Translation of Notification of grant dated Jan. 28, 2019 of corresponding Chinese application No. 201680010478.X.

English Translation of International Preliminary Report on Patentability Chapter I dated Mar. 6, 2018 for PCT Application No. PCT/JP2016/075874.

English Translation of the Written Opinion of the International Search Authority dated Oct. 4, 2016 for PCT Application No. PCT/JP2016/075874.

Office Action dated Jun. 4, 2018 in the corresponding CN application No. 201680010478.X.

English Translation of Office Action for corresponding Korean application No. 10-2017-7027654 dated Apr. 1, 2019.

International Search Report and Written Opinion for PCT Application No. PCT/JP2016/075874, dated Oct. 4, 2016 (including English translation of ISR).

English Translation of Decision to grant a patent dated Oct. 8, 2019 in KR application No. 10-2017-7027654.

* cited by examiner

METHOD FOR PRODUCING ELECTROLYTIC ALUMINUM FOIL

CROSS REFERENCE TO RELATED APPLICATIONS

This application is a continuation of PCT Application No. PCT/JP2016/075874 filed Sep. 2, 2016, which claims the benefit of Japanese Patent Applications No. 2015-175244, filed Sep. 5, 2015 and No. 2016-159099, filed Aug. 15, 2016, all of which are hereby incorporated by reference in their entirety.

BACKGROUND

Technical Field

The present disclosure relates to a method for producing electrolytic aluminum foil, and particularly relates to a method for producing high quality electrolytic aluminum foil excellent in peelability from a cathode surface.

Background

In recent years, the development of lithium ion batteries as batteries for automobiles and personal computers has advanced. In a lithium ion battery, aluminum foil is used as a positive electrode current collector for the improvement of battery capacity.

Aluminum foil is conventionally produced by rolling an aluminum foil material. The lower limit of the thickness of aluminum foil produced by the rolling method is usually about 10 μm. But, in order to further increase the battery capacity of a lithium ion battery for miniaturization, aluminum foil as thin as possible, for example, having a thickness of 5 to 10 μm, is preferably used. Such thin aluminum foil can also be produced by the rolling method, but a problem has been that it is necessary to increase the number of rolling steps, and therefore the production cost is comparatively high.

For copper foil used as the negative electrode current collector of a lithium ion battery, currently, electrolytic copper foil is used for most of the copper foil, and rolled copper foil is not used. Electrolytic copper foil is produced by forming a copper plating film on a cathode drum that is a substrate, and then peeling the copper plating film from the cathode drum. Here, aluminum foil is poor in strength compared with copper foil, and therefore it is especially difficult to, after deposition on a cathode drum, peel, wind, and recover aluminum foil. Therefore, a method for easily peeling aluminum foil deposited on a cathode drum is strongly desired.

In Japanese Patent Application Laid-Open No. 2014-80632, a method for producing aluminum foil by an electrolysis method is described. In order to efficiently produce aluminum foil having good quality, the adjustment of the surface roughness of a cathode is important. When a deep valley portion and a high peak portion are present in part of a cathode surface, aluminum bites into this valley portion easily. When the aluminum film is peeled, this bitten portion provides resistance to cause the breakage or cutting of the aluminum foil. In Japanese Patent Application Laid-Open No. 2014-80632, defining arithmetic average roughness Ra is described, but there is no description of defining maximum height (Ry) and ten-point average roughness (Rz). The present inventors have found that in order to efficiently produce aluminum foil having good quality, particularly defining Rz is effective because Rz is an indicator best representing the extent of the height of peak portions and the depth of valley portions and their numbers.

In addition, in Japanese Patent Application Laid-Open No. 2014-80632, it is described that in order to smooth the surface of electrolytic aluminum foil, the addition of 1-10 phenanthroline to an electrolytic solution is effective, and the addition concentration range is preferably 0.25 to 7.0 g/L. For 1-10 phenanthroline, an anhydride and a hydrate are present, and conventionally, the anhydride has been generally used. But, it has been found that as the amount of 1-10 phenanthroline anhydride added is increased, smoothness improves, but an aluminum film deposited on a cathode surface is hard and brittle. As a result, a problem is that the strength and elongation of the aluminum film decrease, and it is difficult to peel the aluminum film from the cathode surface.

The present disclosure has been made in view of the above circumstances, and the present disclosure is related to providing a method for producing high quality electrolytic aluminum foil excellent in peelability from a cathode surface.

SUMMARY

According to the present disclosure, (1) A method for producing electrolytic aluminum foil, comprising steps of depositing an aluminum film on a surface of a cathode in an electrolytic cell supplied with an electrolytic solution and comprising the cathode; and peeling the deposited aluminum film from the surface of the cathode to provide aluminum foil, wherein the cathode has surface roughness of an arithmetic average roughness (Ra) of 0.10 to 0.40 μm and a ten-point average roughness (Rz) of 0.20 to 0.70 μm.

(2) The method for producing electrolytic aluminum foil according to (1), wherein the cathode is a drum made of titanium.

(3) The method for producing electrolytic aluminum foil according to (1), wherein the electrolytic solution is a molten salt containing 0.01 to 0.5 g/L of 1-10 phenanthroline monohydrate, current density is 10 to 100 mA/cm$^2$, and in the aluminum foil, an arithmetic average roughness Ra of a foil surface is in a range of 0.10 μm or more and 2.50 μm or less at any site, and an average grain diameter is in a range of 1.00 μm or more and 5.00 μm or less at any site.

(4) The method for producing electrolytic aluminum foil according to (3), wherein a difference in the arithmetic average roughness Ra of the foil surface when the arithmetic average roughness Ra is measured in a central portion in a width direction and in an end portion in the width direction on the foil surface is 2.00 μm or less.

(5) The method for producing electrolytic aluminum foil according to (1), wherein the electrolytic solution is a molten salt containing an alkylimidazolium halide and an aluminum halide, or a molten salt containing an alkylpyridinium halide and an aluminum halide.

(6) The method for producing electrolytic aluminum foil according to (1), wherein the surface roughness of the cathode is adjusted by electropolishing.

In the production method according to the present disclosure, by using a cathode having predetermined surface properties, high quality electrolytic aluminum foil excellent in peelability from a cathode surface can be obtained.

DESCRIPTION OF THE EMBODIMENTS

1. Electrolysis

Figure 1:
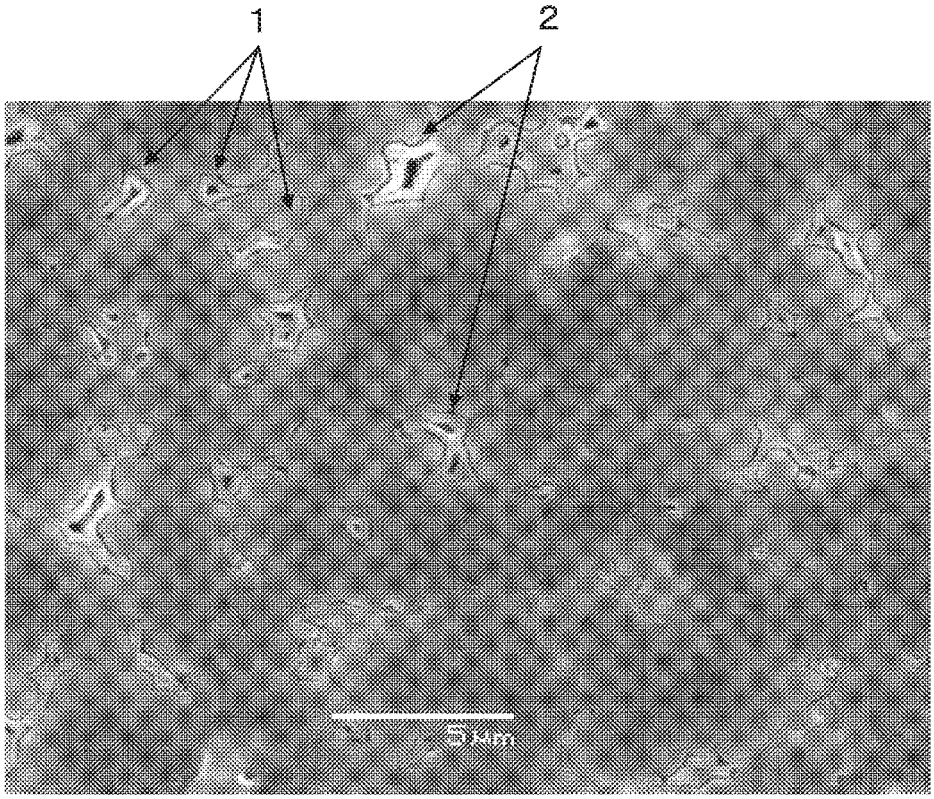
FIG. 1 is an SEM image of Comparative Example 1-6.

Electrolytic aluminum foil according to the present disclosure is produced by depositing an aluminum film on the surface of a cathode in an electrolytic cell supplied with an electrolytic solution and comprising the cathode, and peeling the deposited aluminum film from the surface of the cathode. As used herein, aluminum before peeling deposited on the cathode surface is described as an "aluminum film", and aluminum after peeling is described as "aluminum foil". "Aluminum" refers to pure aluminum having a purity of 99.0% or more and aluminum alloys unless otherwise noted herein.

1-1. Anode and Cathode

In the present disclosure, the anode comprises aluminum. As the cathode, titanium, stainless steel, nickel, carbon, and the like are used. Metals such as titanium, stainless steel, and nickel are excellent in corrosion resistance because dense natural oxide films are formed on the surfaces. In addition, due to the presence of the natural oxide films, adhesiveness to an aluminum film decreases, and therefore the metals are suitable as the cathode. In addition, nonmetal materials such as carbon have low bonding force to an aluminum film, and are therefore suitable as the cathode. In the present disclosure, the cathode is preferably made of titanium.

In the present disclosure, the shapes of the anode and the cathode are not particularly limited, and a plate-shaped anode and a plate-shaped cathode may be used. But, in order to continuously produce aluminum foil, a drum-shaped cathode is preferably used. An electrolytic solution is supplied between an anode and a cathode drum provided opposite to the anode, and while the cathode drum is rotated at a constant rate, a direct current is passed between both electrodes to deposit an aluminum film on the cathode drum surface. The deposited aluminum film is peeled from the cathode drum surface, and the peeled aluminum film is wound around a recovery drum, and thus the aluminum foil can be continuously recovered. For example, after the aluminum film reaches a predetermined thickness, the passage of the current is once stopped, and the cathode drum is rotated to peel the aluminum film, and while the peeled aluminum film is stuck to the recovery drum and laminated, the aluminum foil may be wound. In addition, the aluminum foil may be recovered as a peeled piece simultaneously with the peeling of the aluminum film.

When large irregularities are present in part of the cathode surface, the deposited aluminum bites into the depression. When the aluminum film biting into the depression is peeled from the cathode surface, high peel resistance occurs, and thus the aluminum foil is broken or cut.

Such peel resistance is influenced by the surface roughness of the drum. In the present disclosure, as indicators representing surface roughness, arithmetic average roughness (Ra) and ten-point average roughness (Rz) are defined. Thus, the peel resistance is reduced, and the aluminum film can be easily peeled from the cathode surface.

For Ra, only reference length is extracted from a roughness curve in the direction of its average line, the absolute values of deviations from the average line to the measured curve in this extracted portion are summed up, and the average value is expressed in micrometers (μm). In the present disclosure, the arithmetic average roughness (Ra) of the cathode surface is defined as 0.10 to 0.40 μm. In order to set the arithmetic average roughness (Ra) of the cathode surface at less than 0.10 μm, a long time is required for electropolishing treatment, and therefore the electropolishing efficiency decreases. On the other hand, when the arithmetic average roughness (Ra) of the cathode surface is more than 0.40 μm, peeling is difficult, and the aluminum foil cannot be recovered, and the peelability, appearance properties, and uniformity of the aluminum foil cannot be achieved. The arithmetic average roughness (Ra) of the cathode surface is preferably 0.15 to 0.30 μm.

For Rz, only reference length is extracted from a roughness curve in the direction of its average line, measurement is performed from the average line in this extracted portion in the direction of longitudinal magnification, the sum of the average value of the absolute values of the heights of the highest peak to the fifth peak (Yp) and the average value of the absolute values of the heights of the lowest valley to the fifth valley (Yv) is obtained, and this value is expressed in micrometers (μm). Rz is an indicator representing the extent and numbers of high peak portions and deep valley portions, and is a particularly important indicator of surface roughness in the present disclosure. In the present disclosure, the ten-point average roughness (Rz) of the cathode surface is defined as 0.20 to 0.70 μm. When the ten-point average roughness (Rz) of the cathode surface is less than 0.20 μm, the peelability is too good, and therefore the aluminum foil peels during electrolysis, and therefore the uniformity of the aluminum foil is poor. On the other hand, when the ten-point average roughness (Rz) of the cathode surface is more than 0.70 μm, grain boundaries and cracks occur in the electrolytic aluminum foil, and quality decrease is caused, and the peelability, appearance properties, and uniformity of the aluminum foil cannot be achieved. The ten-point average roughness (Rz) of the cathode surface is preferably 0.25 to 0.50 μm.

1-2. Electrolytic Solution

As understood from the fact that the standard electrode potential of aluminum is −1.662 V vs. SHE, it is usually impossible to electrodeposit aluminum from an aqueous solution. Therefore, as the electrolytic solution for electrodepositing aluminum, a molten salt as a mixture with an aluminum salt, or an organic solvent in which an aluminum salt is dissolved is used.

Molten salts can be broadly divided into inorganic molten salts and organic room temperature molten salts. In the present disclosure, as the organic room temperature molten salt, a molten salt containing an alkylimidazolium halide and an aluminum halide, or a molten salt containing an alkylpyridinium halide and an aluminum halide is preferably used. The alkylimidazolium halide is, for example, an alkylimidazolium chloride. Specific examples include 1-ethyl-3-methylimidazolium chloride (hereinafter described as "EMIC"). The alkylpyridinium halide is, for example, an alkylpyridinium chloride. Specific examples include 1-butylpyridinium chloride (hereinafter described as "BPC"). Specific examples of the aluminum halide include aluminum chloride (hereinafter described as "$AlCl_3$"). The melting point of a mixture of EMIC and $AlCl_3$ decreases to around −50° C. depending on the composition. Therefore, the electrodeposition of aluminum can be carried out in a lower temperature environment. From the viewpoint of the viscosity and conductivity of the electrolytic solution, the combination of EMIC and $AlCl_3$ is most preferred. The molar ratio of EMIC to $AlCl_3$ (EMIC:$AlCl_3$) and the molar ratio of BPC to $AlCl_3$ (BPC:$AlCl_3$) are both preferably 2:1 to 1:2, more preferably 1:1 to 1:2.

1-3. Additive

In the present disclosure, 1-10 phenanthroline monohydrate as an additive is preferably added to the above molten salt. 1-10 Phenanthroline includes anhydrides and hydrates, and in the present disclosure, for the purpose of controlling surface roughness in predetermined ranges, a hydrate is used. The concentration of 1-10 phenanthroline monohydrate in the molten salt is 0.01 to 0.50 g/L, preferably 0.1 to 0.25 g/L. When the concentration of 1-10 phenanthroline monohydrate is 0.01 to 0.50 g/L, electrolytic aluminum foil having uniform surface roughness in the central portion in the width direction and in the end portions in the width direction can be produced. When the concentration of 1-10 phenanthroline monohydrate is 0.1 to 0.25 g/L, the film is not too hard, and is more easily peeled, and the electrolytic aluminum foil is easily produced. When the concentration of 1-10 phenanthroline monohydrate is less than 0.01 g/L, the surface roughness of the aluminum foil is too large. On the other hand, when the concentration of 1-10 phenanthroline monohydrate is more than 0.50 g/L, the aluminum film is hard and brittle, and peeling from the cathode surface is difficult.

Additives other than 1-10 phenanthroline monohydrate can be appropriately added to the molten salt. Examples of other additives include benzene, toluene, and xylene.

1-4. Electrolysis Conditions

In the present disclosure, the temperature of the electrolytic solution is preferably within the range of 10 to 150° C. More preferably, the temperature of the electrolytic solution is within the range of 25° C. to 100° C. When the temperature of the electrolytic solution is less than 10° C., the viscosity and resistance of the electrolytic solution increase, and therefore the maximum current density decreases. As a result, the electrodeposition efficiency decreases, and the deposition of the aluminum film becomes nonuniform easily. On the other hand, when the temperature of the electrolytic solution is more than 150° C., the composition of the electrolytic solution is unstable due to the volatilization and decomposition of the compounds constituting the electrolytic solution. Particularly when a molten salt containing EMIC and $AlCl_3$ is used as the electrolytic solution, the volatilization of $AlCl_3$ and the decomposition of the 1-ethyl-3-methylimidazolium cation are significant. Further, the energy for maintaining the temperature of the electrolytic solution is also high, and the deterioration of the electrolytic cell is also promoted, and therefore the production efficiency decreases.

Next, direct current density as an electrodeposition condition will be described. The current density is preferably 10 to 400 mA/cm$^2$, more preferably 20 to 200 mA/cm$^2$. When the electrolytic solution contains 1-10 phenanthroline monohydrate, the current density is preferably 10 to 100 mA/cm$^2$, more preferably 10 to 40 mA/cm$^2$. The electrodeposition rate corresponds to the current density, and therefore when the current density is less than 10 mA/cm$^2$, a decrease in production efficiency is caused. On the other hand, because of the restriction of the liquid resistance of the electrolytic solution, it is difficult for the current density to be more than 400 mA/cm$^2$. Even if the current density is more than 400 mA/cm$^2$, the electrodeposition rate is too high, and the thickness of the aluminum film becomes nonuniform easily.

2. Electropolishing

Next, in order to adjust the surface roughness Ra and Rz of the cathode as described above, in the present disclosure, electropolishing is used. Here, the electropolishing is a technique for smoothing a metal surface utilizing the fact that when a current is passed through a metal immersed in a polishing liquid, a difference in dissolution rate occurs between the raised and depressed portions of the metal surface.

Conventionally, as titanium polishing methods, mechanical polishing such as buffing, chemical polishing using an etching agent, and the above electropolishing are used. For the adjustment of the surface roughness of a cathode drum made of titanium, particularly mechanical polishing has often been utilized, but it has been difficult to obtain a high degree of smoothness of the titanium surface, and fine flaws have often remained on the surface. In addition, in chemical polishing such as etching, there has been the inconvenience of a nonuniform polished surface. Compared with such mechanical polishing and chemical polishing, in electropolishing, a high degree of smoothness is obtained, and a strong passivation film is also formed on the surface layer, and therefore the peelability of aluminum foil improves. Further, on the surface of a cathode drum made of titanium whose surface roughness is adjusted by electropolishing, the adhesion of foreign substances is also suppressed, and the surface is excellent in cleanliness, and is also advantageous in terms of the maintainability of the drum.

The electropolishing treatment can be carried out using an ethylene glycol solution of NaCl or an ethylene glycol solution of KCl. A cathode drum made of titanium is immersed in these solutions, and by voltage application to this and ultrasonic cleaning, the drum surface is polished like a mirror surface. By combining high voltage electrolysis corresponding to rough polishing and low voltage electrolysis corresponding to finish polishing, the drum surface is more effectively polished. In addition, Ra and Rz can be adjusted by treatment time, that is, voltage application time. Preferred electrolysis voltage and treatment time of high voltage electrolysis are 15 to 60 V and 30 seconds to 5 minutes, and more preferred electrolysis voltage and treatment time are 20 to 40 V and 1 to 3 minutes. Preferred electrolysis voltage and treatment time of low voltage electrolysis are 6 to 15 V and 5 to 60 minutes, and more preferred electrolysis voltage and treatment time are 8 to 12 V and 10 to 30 minutes. For the combination, for example, by removing soil and the oxide film on the surface layer by the first high voltage electrolysis, then carrying out ultrasonic cleaning, and then alternately carrying out a set of high voltage electrolysis and ultrasonic cleaning and a set of low voltage electrolysis and ultrasonic cleaning, mirror polishing excellent in smoothness can be carried out.

3. Electrolytic Aluminum Foil

In the electrolytic aluminum foil according to the present disclosure, the arithmetic average roughness Ra of the foil surface is in the range of 0.10 μm or more and 2.50 μm or less at any site. Particularly, the difference in the arithmetic average roughness Ra of the foil surface when the arithmetic average roughness Ra is measured in the central portion in the width direction and in an end portion in the width direction on the foil surface is preferably 2.00 μm or less. Here, the "width direction" is the width direction of a cathode plate, and refers to the direction perpendicular to the rotation direction of a cathode drum when the cathode is drum-shaped. The "central portion in the width direction" is the vicinity of the center in the width direction, and specifically means a portion from the center in the width direction to a distance of ¼ of the width. The "end portion in the width direction" means a portion from an endmost portion in the width direction to a distance of ¼ of the width. The arithmetic average roughness Ra of the foil surface is the arithmetic average roughness of the surface that has been in contact with the electrolytic solution, and is distinguished from the arithmetic average roughness of the surface that has been in contact with the cathode. In the present disclosure, the foil surface refers to the surface opposite to the surface in contact with the cathode, and the surface in contact with the cathode is referred to as a foil back surface.

In addition, in the electrolytic aluminum foil according to the present disclosure, the average grain diameter is in the range of 1.00 μm or more and 5 μm or less at any site. The grain diameter influences the peelability and particularly strength and elongation of the aluminum foil. When the average grain diameter is less than 1.00 μm, the aluminum film hardens, and cracks easily, and therefore the peelability decreases. When the average grain diameter is more than 5.00 μm, the gaps between neighboring grains are wide, and therefore the porosity decreases. The average grain diameter is calculated by a method of drawing a line having a length equal to 100 μm on an SEM image, and allocating by the number of particles on the line.

A feature of an aluminum film produced by an electrolysis method is that current concentration occurs easily in the end portions in the width direction. Therefore, even if electrodeposition is performed, for example, assuming that the thickness of aluminum foil is set at 10 μm, the deposited aluminum grows like a dendrite when the current concentrates in the end portions in the width direction, and the thickness of the aluminum film increases extremely, and the surface roughness also increases. On the other hand, due to their influence, the thickness of the aluminum film decreases in the central portion in the width direction, and therefore the peelability from the cathode surface tends to decrease. In the aluminum film according to the present disclosure, the arithmetic average roughness Ra of the film surface is in the range of 0.10 μm or more and 2.50 μm or less at any site, and therefore the peelability from the cathode surface is excellent. The surface roughness of the aluminum film and the surface roughness of the aluminum foil are equal. When the arithmetic average roughness Ra of the foil surface is less than 0.1 μm, the foil is too smooth, and is unsuitable for use for a current collector for an electricity storage device. On the other hand, when the arithmetic average roughness Ra of the foil surface is more than 2.50 μm, the porosity decreases.

The thickness of the electrolytic aluminum foil is usually 1 μm to 20 μm, and may be appropriately selected depending on the application. For example, when the electrolytic aluminum foil is used as the positive electrode current collector of a lithium ion battery, the thickness is preferably 8 to 12 μm.

The electrolytic aluminum foil according to the present disclosure is preferably used in electricity storage devices such as lithium ion secondary batteries and supercapacitors.

EXAMPLES

Next, the present disclosure will be described in more detail based on Examples, but the present disclosure is not limited to these.

Example 11

<Producing of Cathode Drums Made of Titanium>

A titanium rod was electropolished to produce each of cathode drums made of titanium having various surface roughnesses (Ra and Rz). Specifically, a titanium rod having a purity of 99.9%, a diameter of 10 mm φ, and a length of 100 mm was used as an anode, a SUS316 plate having a width of 100 mm and a length of 100 mm was used as a cathode, and a solution obtained by dissolving 10 g of NaCl in 150 mL of ethylene glycol was used as an electrolytic solution. The SUS316 plate, the cathode, was disposed so as to be spaced from the curved surface of the titanium rod, the anode, at a substantially constant distance.

In the electropolishing, with the temperature of the electrolytic solution set at 25° C., (1) pretreatment electrolysis at an electrolysis voltage of 25 V for 3 minutes was performed. Then, (2) the surface of the electrolyzed titanium rod was ultrasonically cleaned to remove the products formed on the surface. Next, (3) the temperature of the electrolytic solution was maintained at 25° C., and electrolysis at a high electrolysis voltage of 25 V for 3 minutes and further electrolysis at a low electrolysis voltage of 10 V for 30 minutes were performed, and finally (4) the surface of the electrolyzed titanium rod was ultrasonically cleaned. Such operations of (3) to (4) were repeated twice to produce a cathode drum made of titanium.

<Electrodeposition of Aluminum Foil>

According to the following procedure, aluminum foil was formed by electrodeposition on the surface of each cathode drum made of titanium obtained by the above electropolishing.

As an electrolytic solution, one obtained by mixing at a molar ratio of EMIC:$AlCl_3$=1:2 at a temperature of 50° C. was used. The electrolytic solution was placed in an electrolytic cell, and the cathode drum made of titanium obtained by the above electropolishing, as a cathode, and a 99.9% aluminum plate (width 80 mm, length 200 mm) as an anode were disposed in the electrolytic solution. Here, the aluminum plate, the anode, was disposed so as to be spaced from the curved surface of the cathode drum made of titanium at a substantially constant distance. Then, a direct current electrolysis operation was performed at a current density of 40 mA/$cm^2$ for 12 minutes to electrodeposit aluminum foil having a thickness of about 10 j m on the surface of the cathode drum made of titanium. After the electrolysis processing, the aluminum foil electrodeposited on the surface of the cathode drum made of titanium was washed with acetone and pure water, and then while the aluminum foil was peeled from the cathode drum made of titanium, the aluminum foil was wound around a winding roll and recovered as a sample.

For the aluminum foil samples and the cathode drums made of titanium produced as described above, the following evaluation was performed.

<Surface Roughness of Cathode Drums Made of Titanium>

The surface roughness (Ra and Rz) of the cathode drums made of titanium was measured by a laser microscope. Ra and Rz represent arithmetic average roughness and ten-point average roughness defined in JIS B 0601-1994, respectively. The results are shown in Table 1.

<Properties of Aluminum Foil>

As the properties of the aluminum foil, peelability, appearance properties, and uniformity were evaluated as follows.

(Peelability)

First, for the peelability, each aluminum foil sample electrodeposited on the surface of each cathode drum made of titanium was washed with acetone and pure water, and for one that peeled from the drum without touching, the peelability was accepted (Good), and for one that could not be peeled, the peelability was rejected (Poor). Also in the following evaluation, acceptance is "Good", and rejection is "Poor".

(Appearance Properties)

Figure 2:
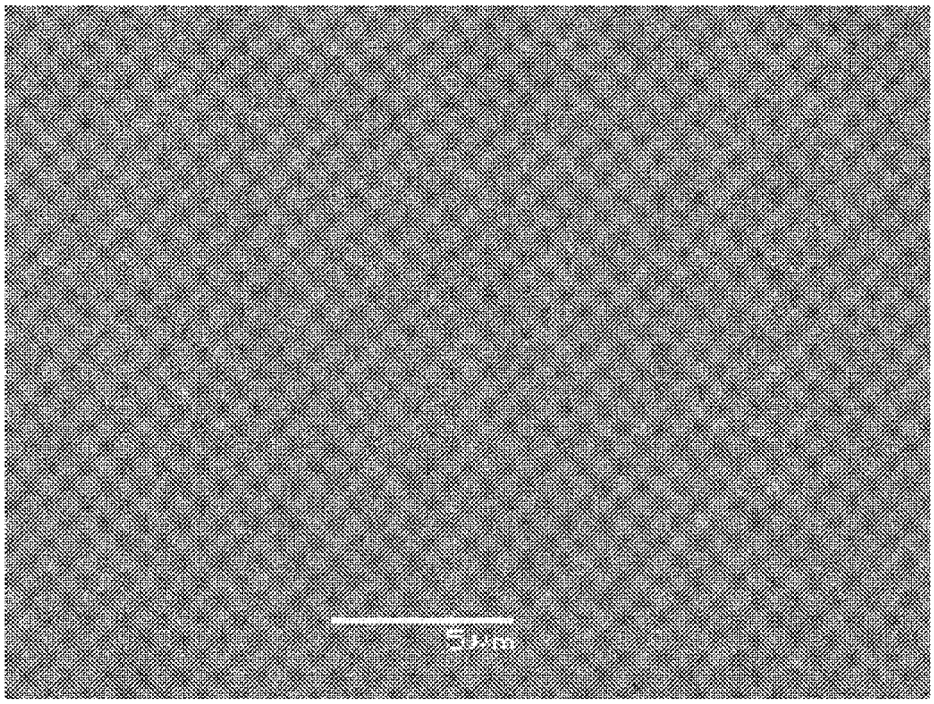
FIG. 2 is an SEM image of Example 1-3.

Next, the appearance properties were evaluated by arbitrarily selecting 10 fields of view of 25 μm×20 μm on the surface (cathode drum contact surface) of each aluminum foil sample, and observing by an SEM. Specifically, for one in which no pinholes were observed at all in all fields of view, the appearance properties were determined as "Good", and for one in which there were one or more fields of view in which one or more pinholes were observed, the appearance properties were determined as "Poor". As examples, FIG. 1 is an SEM photograph of Comparative Example 1-6, and FIG. 2 is an SEM photograph of Example 1-3. In FIG. 1, a pinhole 2 is observed near the center in the upper portion of the figure. In contrast to this, in FIG. 2, no pinholes are observed at all. Reference numeral 1 in FIG. 1 denotes grain boundaries. The lengths of the scale lines in FIG. 1 and FIG. 2 are both 5 μm.

(Uniformity)

Further, the uniformity was evaluated as follows. As shown in FIG. 1, a case where the entire color unevenness was significant was determined as "Poor", as poor in uniformity, and a case where the entire color unevenness was not significant was determined as "Good".

The evaluation results for the above properties of the aluminum foil are shown in Table 1.

<Electropolishing Efficiency>

Electropolishing efficiency when each titanium rod was electropolished to obtain each cathode drum made of titanium was evaluated as follows. A case where in order to achieve the target surface roughness, the upper limit of the preferred treatment time of low voltage electrolysis described above, 60 minutes, was exceeded was determined as "Poor", poor in electropolishing efficiency, and other cases were determined as "Good". The results are shown in Table 1.

<Overall Evaluation>

From the evaluation results of the surface roughness of each cathode drum made of titanium, the properties of the aluminum foil, and the electropolishing efficiency described above, overall evaluation was determined as follows. A case where the peelability, appearance properties, uniformity, and electropolishing efficiency were all determined as "Good" was determined as "Good" in overall evaluation, and other cases were determined as "Poor". The results are shown in Table 1.

TABLE 1

| | Surface roughness | | Properties of aluminum foil | | | | |
|---|---|---|---|---|---|---|---|
| | Ra (μm) | Rz (μm) | Peelability | Appearance properties | Uniformity | Electropolishing efficiency | Overall evaluation |
| Example 1-1 | 0.11 | 0.20 | ○ | ○ | ○ | ○ | ○ |
| Example 1-2 | 0.16 | 0.30 | ○ | ○ | ○ | ○ | ○ |
| Example 1-3 | 0.10 | 0.42 | ○ | ○ | ○ | ○ | ○ |
| Example 1-4 | 0.23 | 0.47 | ○ | ○ | ○ | ○ | ○ |
| Example 1-5 | 0.25 | 0.51 | ○ | ○ | ○ | ○ | ○ |
| Example 1-6 | 0.37 | 0.54 | ○ | ○ | ○ | ○ | ○ |
| Example 1-7 | 0.33 | 0.65 | ○ | ○ | ○ | ○ | ○ |

TABLE 1-continued

| | Surface roughness | | Properties of aluminum foil | | | | |
|---|---|---|---|---|---|---|---|
| | Ra (μm) | Rz (μm) | Peelability | Appearance properties | Uniformity | Electropolishing efficiency | Overall evaluation |
| Example 1-8 | 0.19 | 0.67 | ○ | ○ | ○ | ○ | ○ |
| Comparative Example 1-1 | 0.08 | 0.12 | ○ | ○ | x | x | x |
| Comparative Example 1-2 | 0.11 | 0.14 | ○ | ○ | x | ○ | x |
| Comparative Example 1-3 | 0.09 | 0.21 | ○ | ○ | ○ | x | x |
| Comparative Example 1-4 | 0.15 | 0.76 | x | x | x | ○ | x |
| Comparative Example 1-5 | 0.22 | 0.82 | x | x | x | ○ | x |
| Comparative Example 1-6 | 0.17 | 0.92 | x | x | x | ○ | x |
| Comparative Example 1-7 | 0.42 | 0.69 | x | x | x | ○ | x |

In Examples 1-1 to 1-8, Ra and Rz were within the ranges defined in the present disclosure, and therefore the aluminum foil properties (peelability, appearance properties, and uniformity) and the electropolishing efficiency were both good, and the overall evaluation was accepted.

In contrast to this, in Comparative Example 1-1, Rz was too smaller than the range defined in the present disclosure, and therefore the aluminum foil peeled during electrolysis, and the uniformity was rejected. In addition, Ra was also too smaller than the range defined in the present disclosure, and therefore in order to achieve this, the titanium electropolishing efficiency was rejected. As a result, the overall evaluation was rejected.

In Comparative Example 1-2, Rz was too smaller than the range defined in the present disclosure, and therefore the aluminum foil peeled during electrolysis, and the uniformity was rejected. As a result, the overall evaluation was rejected.

In Comparative Example 1-3, Ra was too smaller than the range defined in the present disclosure, and therefore in order to achieve this, the titanium electropolishing efficiency was rejected. As a result, the overall evaluation was rejected.

In Comparative Examples 1-4 to 1-6, Rz was too larger than the range defined in the present disclosure, and therefore grain boundaries and cracks occurred in the aluminum foil, and the peelability, appearance properties, and uniformity of the aluminum foil were rejected. As a result, the overall evaluation was rejected.

In Comparative Example 1-7, Ra was too larger than the range defined in the present disclosure, and therefore the peelability, appearance properties, and uniformity of the aluminum foil were rejected. As a result, the overall evaluation was rejected.

Example 2

<Electrodeposition of Aluminum Foil>

Each electrolytic solution was prepared by adding, to a solution obtained by mixing at a molar ratio of EMIC: $AlC_3$=1:2, 1-10 phenanthroline monohydrate so as to reach an additive concentration described in Table 2. The electrolytic solution was placed in an electrolytic cell, and a titanium plate (width 30 mm, length 60 mm, surface roughness Ra 0.10 μm), a cathode, and a 99.9% aluminum plate (width 50 mm, length 60 mm), an anode, were placed in the electrolytic solution. Here, the aluminum plate, the anode, was disposed opposite to the titanium plate, the cathode, so that the electrode-to-electrode distance was 2 cm. The titanium plate was subjected to masking with a tape made of PTFE so that the electrodeposition area was 20×20 $mm^2$. The electrolytic solution was stirred by a magnetic stirrer. A current was passed at a current density described in Table 1 until a film thickness of 10 μm was reached, to deposit an aluminum film on the cathode surface. After the completion of the passage of the current, the aluminum film deposited on the titanium plate was washed with acetone and pure water. The deposited aluminum film was peeled from the titanium plate using tweezers, to recover the electrolytic aluminum foil.

For the aluminum foil produced, the evaluation of smoothness, porosity, and peelability was performed. The evaluation results are shown in Table 2.

(Smoothness)

The surface roughness of the electrolytic aluminum foil made was measured by a laser microscope. The surface roughness was measured in the central portion in the width direction and in an end portion in the width direction. Regarding surface roughness $Ra_1$ in the central portion in the width direction, measurement was performed at three points in a range from the center in the width direction to a distance of ¼ of the width, and the average value was calculated. Regarding surface roughness $Ra_2$ in an end portion in the width direction, measurement was performed at three points in a range from an endmost portion in the width direction to a distance of ¼ of the width, and the average value was calculated. When the surface roughness $Ra_1$ and the surface roughness $Ra_2$ were both within the range of 0.1 μm or more and 2.5 μm or less, the smoothness was determined as "Good". When either one of the surface roughness $Ra_1$ and the surface roughness $Ra_2$ was outside the above range, or the surface roughness $Ra_1$ and the surface roughness $Ra_2$ were both outside the above range, the smoothness was determined as "Poor".

(Porosity)

The grain diameter of the electrolytic aluminum foil made was calculated by a method of drawing a line having a length equal to 100 μm on an SEM image, and allocating by the number of particles on the line.

The grain diameter was measured in the central portion in the width direction and in an end portion in the width direction. Regarding the grain diameter in the central portion in the width direction, measurement was performed at three points in a range from the center in the width direction to a distance of ¼ of the width, and the average value was calculated. Regarding the grain diameter in an end portion in the width direction, measurement was performed at three points in a range from an endmost portion in the width direction to a distance of ¼ of the width, and the average value was calculated. In addition, the surface of the electrolytic aluminum foil made was observed by an FE-SEM (manufactured by Zeiss) and an EPMA (manufactured by JEOL). When no gaps, defects, or the like were seen, the porosity was determined as "Good". When gaps, defects, and the like were seen, the porosity was determined as "Poor".

(Peelability)

When the deposited aluminum film was peeled from the cathode surface for a case in which the aluminum foil was recovered without rupture, the peelability was determined as "Good". When cracks occurred in the aluminum foil, or the aluminum foil collapsed, and the aluminum foil could not be recovered with remaining in the shape of a film, the peelability was determined as "Poor".

TABLE 2

| | Additive concentration (g/L) | Current density ($mAcm^{-2}$) | $R_{a1}$ (Central portion in width direction) (μm) | $Ra_2$ (End portion in width direction) (μm) | Average grain diameter (Central portion in width direction) (μm) | Average grain diameter (End portion in width direction) (μm) | Smoothness | Porosity | Peelability |
|---|---|---|---|---|---|---|---|---|---|
| Example 2-1 | 0.01 | 10 | 1.00 | 2.50 | 4.61 | 4.92 | ○ | ○ | ○ |
| Example 2-2 | 0.01 | 40 | 0.87 | 2.42 | 4.38 | 4.83 | ○ | ○ | ○ |
| Example 2-3 | 0.01 | 100 | 0.77 | 2.38 | 4.06 | 4.52 | ○ | ○ | ○ |
| Example 2-4 | 0.05 | 10 | 0.90 | 2.10 | 3.89 | 4.24 | ○ | ○ | ○ |
| Example 2-5 | 0.05 | 40 | 0.88 | 1.98 | 3.62 | 4.14 | ○ | ○ | ○ |
| Example 2-6 | 0.05 | 100 | 0.72 | 1.97 | 3.56 | 3.99 | ○ | ○ | ○ |
| Example 2-7 | 0.1 | 10 | 0.60 | 1.00 | 3.45 | 3.43 | ○ | ○ | ○ |
| Example 2-8 | 0.1 | 40 | 0.56 | 0.96 | 3.20 | 3.05 | ○ | ○ | ○ |
| Example 2-9 | 0.1 | 100 | 0.50 | 0.87 | 3.01 | 2.98 | ○ | ○ | ○ |
| Example 2-10 | 0.25 | 10 | 0.43 | 0.45 | 2.80 | 4.32 | ○ | ○ | ○ |
| Example 2-11 | 0.25 | 40 | 0.38 | 0.43 | 2.30 | 4.18 | ○ | ○ | ○ |
| Example 2-12 | 0.25 | 100 | 0.35 | 0.40 | 233 | 3.97 | ○ | ○ | ○ |
| Example 2-13 | 0.5 | 10 | 0.30 | 0.30 | 2.02 | 2.09 | ○ | ○ | ○ |
| Example 2-14 | 0.5 | 40 | 0.24 | 0.19 | 1.82 | 1.82 | ○ | ○ | ○ |
| Example 2-15 | 0.5 | 100 | 0.10 | 0.10 | 1.53 | 1.46 | ○ | ○ | ○ |
| Comparative Example 2-1 | 0 | 10 | 1.20 | 4.50 | 5.60 | 6.80 | x | x | x |
| Comparative Example 2-2 | 0.005 | 40 | 1.00 | 4.20 | 4.64 | 4.34 | x | x | ○ |
| Comparative Example 2-3 | 1 | 40 | 0.19 | 0.18 | 1.25 | 1.34 | ○ | ○ | x |
| Comparative Example 2-4 | 0.1 | 5 | 1.50 | 1.20 | 6.12 | 6.87 | ○ | x | x |
| Comparative Example 2-5 | 0.1 | 150 | 1.30 | 2.70 | 5.45 | 5.91 | ○ | x | x |
| Comparative Example 2-6 | 3 | 100 | 0.08 | 0.05 | 0.98 | 0.95 | ○ | ○ | x |

Figure 3:
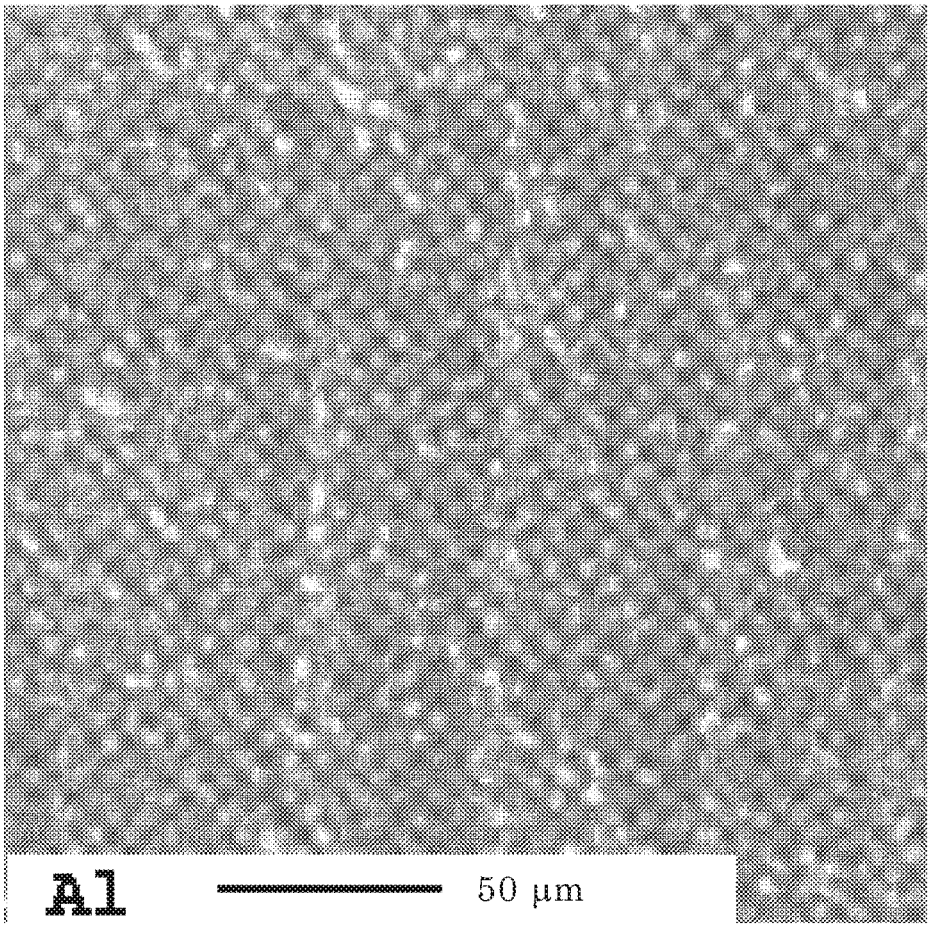
FIG. 3 is an EPMA surface analysis image of the Al element of Example 2-12.

As shown in Table 2, it was seen that in Examples 2-1 to 2-15, the smoothness, porosity, and peelability were excellent. For example, it was seen that the electrolytic aluminum foil of Example 2-12 had no gaps or defects as shown in FIG. 3, and had uniform surface roughness. On the other hand, in Comparative Examples 2-1 and 2-2, the concentration of 1-10 phenanthroline monohydrate was less than 0.01 g/L, and therefore the surface roughness in the end portion in the width direction increased. In Comparative Example 2-1, the smoothness, porosity, and peelability were all poor, and electrolytic aluminum foil could not be produced. In addition, in Comparative Example 2-2, the aluminum film was peeled, but the smoothness and porosity were poor, and electrolytic aluminum foil suitable for a current collector could not be obtained.

Figure 4:
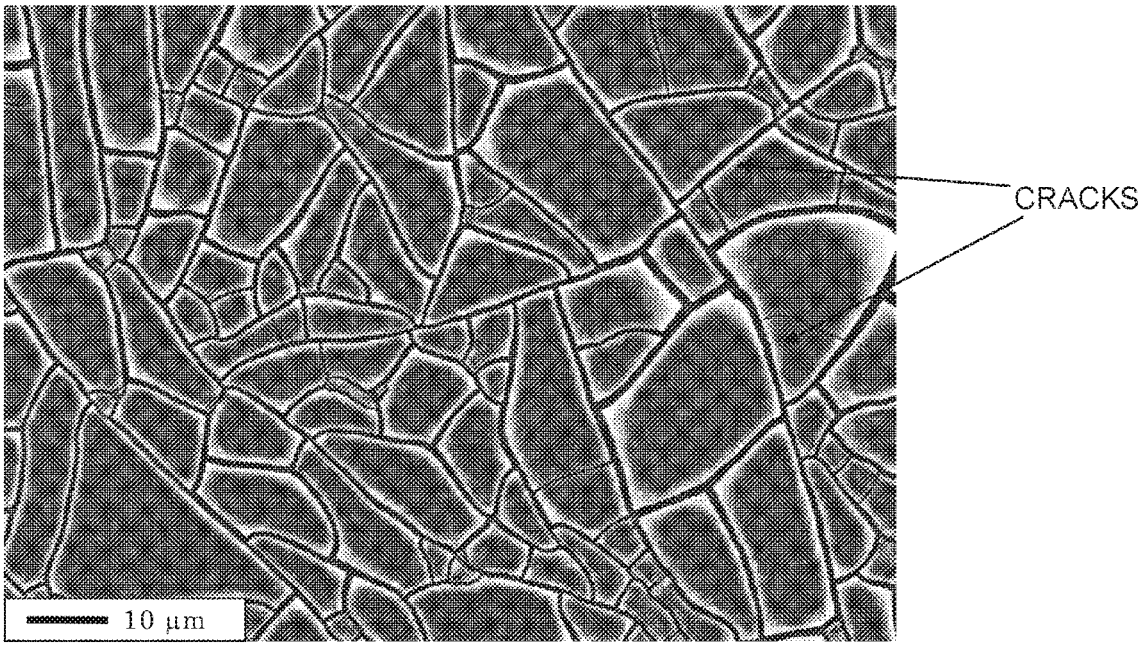
FIG. 4 is an SEM image of Comparative Example 2-3.

In Comparative Example 2-3, the concentration of 1-10 phenanthroline monohydrate was more than 0.5 g/L, and therefore the aluminum film hardened, and cracks occurred as shown in FIG. 4. Therefore, the aluminum film could not be peeled from the titanium plate, and electrolytic aluminum foil could not be recovered.

Figure 5:
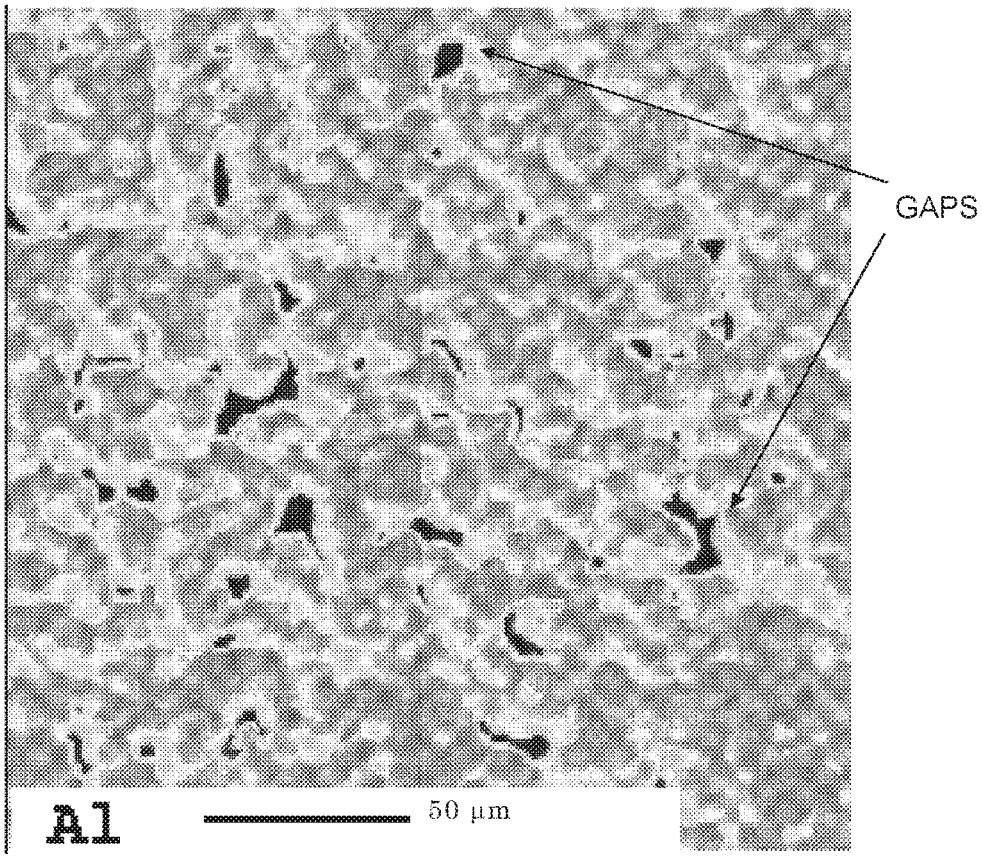
FIG. 5 is an EPMA surface analysis image of the Al element of Comparative Example 2-4.

In Comparative Example 2-4, the current density was less than 10 $mA/cm^2$, and therefore the particle diameter was more than 5.00 μm, there were many gaps as shown in FIG. 5, the surface state was rough, and electrolytic aluminum foil could not be recovered.

In Comparative Example 2-5, the current density was more than 100 mA/cm$^2$, and therefore the surface of the aluminum film burned black, and the surface state was rough. Therefore, electrolytic aluminum foil could not be recovered.

In Comparative Example 2-6, the concentration of 1-10 phenanthroline monohydrate was significantly more than 0.5 g/L, and therefore the average grain diameter was less than 1.00 μm, the film hardened, and cracked easily, and the peelability decreased.

From the above, in the method for producing electrolytic aluminum foil according to the present disclosure, the cathode has the surface roughness of an arithmetic average roughness (Ra) of 0.10 to 0.40 μm and a ten-point average roughness (Rz) of 0.20 to 0.70 μm, and thus electrolytic aluminum foil excellent in peelability from the cathode surface can be produced.

INDUSTRIAL APPLICABILITY

According to the present disclosure, electrolytic aluminum foil easily peeled from a cathode drum made of titanium, and having high quality can be efficiently produced, and an industrially significant effect is achieved.

What is claimed is:

1. A method for producing electrolytic aluminum foil, comprising:

depositing an aluminum film on a surface of a cathode in an electrolytic cell supplied with an electrolytic solution and wherein the electrolytic cell comprises the cathode; and peeling the deposited aluminum film from the surface of the cathode to provide aluminum foil, wherein the cathode has surface roughness of an arithmetic average roughness (Ra) of 0.10 to 0.40 μm and a ten-point average roughness (Rz) of 0.20 to 0.70 μm, the depositing is conducted at a current density is 10 to 100 mA/cm$^2$, and an average grain diameter is in a range of 1.00 μm or more and 5.00 μm or less at any site n the aluminum foil.

2. The method for producing electrolytic aluminum foil according to claim 1, wherein the cathode is a drum made of titanium.

3. The method for producing electrolytic aluminum foil according to claim 1, wherein the electrolytic solution is a molten salt containing 0.01 to 0.5 g/L of 1-10 phenanthroline monohydrate, in the aluminum foil, an arithmetic average roughness Ra of a foil surface is in a range of 0.10 μm or more and 2.50 μm or less at any site.

4. The method for producing electrolytic aluminum foil according to claim 3, wherein a difference in the arithmetic average roughness Ra of the foil surface measured in a central portion in a width direction and the arithmetic average roughness Ra measured in an end portion in the width direction on the foil surface is 2.00 μm or less.

5. The method for producing electrolytic aluminum foil according to claim 1, wherein the electrolytic solution is a molten salt containing an alkylimidazolium halide and an aluminum halide, or a molten salt containing an alkylpyridinium halide and an aluminum halide.

6. The method for producing electrolytic aluminum foil according to claim 1, further comprising adjusting, the surface roughness of the cathode by electropolishing.

* * * * *